US005190177A

United States Patent [19]

Collins

[11] Patent Number: 5,190,177

[45] Date of Patent: Mar. 2, 1993

[54] METAL SCREW CLOSURES FOR PACKAGING CONTAINERS

[75] Inventor: Malcolm G. Collins, Wantage, United Kingdom

[73] Assignee: CMB Foodcan plc, United Kingdom

[21] Appl. No.: 681,241

[22] Filed: Apr. 5, 1991

[30] Foreign Application Priority Data

Apr. 6, 1990 [GB] United Kingdom ..... 9007868
Jun. 7, 1990 [GB] United Kingdom ..... 9012688

[51] Int. Cl.[5] ..... B65D 41/34
[52] U.S. Cl. ..... 215/252
[58] Field of Search ..... 215/252, 258

[56] References Cited

U.S. PATENT DOCUMENTS 4,503,986 3/1985 Nixdorff et al. ..... 215/252
4,511,053 4/1985 Brandes et al. ..... 215/252
4,560,076 12/1985 Boik ..... 215/252
4,694,970 8/1987 Hayes ..... 215/252
4,746,026 5/1988 Leonhardt ..... 215/252
4,875,594 10/1989 Ochs ..... 215/252
4,989,740 2/1991 Vercillo ..... 215/252

*Primary Examiner*—Allan N. Shoap
*Assistant Examiner*—Nova Stucker
*Attorney, Agent, or Firm*—Diller, Ramik & Wight

[57] ABSTRACT

A screw closure is associated with a container mouth and is defined by a metal closure body having a closure panel and a peripheral skirt which extends to an inwardly and upwardly directed curl terminating in a free edge. An annular shoulder of the peripheral skirt cooperates with the curl to captively retain therebetween an upper portion of a plastic security ring joined to a lower portion by a line of weakening with the lower security ring portion being prevented from rotating relative to an associated container neck. The terminal end of the curl is seated in a recess of the security ring upper portion in deforming engagement therewith.

16 Claims, 7 Drawing Sheets

METAL SCREW CLOSURES FOR PACKAGING CONTAINERS

This invention is concerned with metal screw closures for packaging containers, in particular (but not exclusively) with screw closures of the kind having peripheral skirts with an internal lining of a gasket compound which, after non-rotary application of the closure to the neck of a container, is capable of conforming itself permanently to screw thread formations on the container neck. The closure is first fitted on the container by the food manufacturer by a simple pressing action, but subsequently requires removal (and replacement) by the consumer using a conventional twisting action. Such closures are accordingly often referred to as "press-twist" or, more commonly, PT closures, a nomenclature which will be used hereinafter whenever appropriate.

PT and other vacuum closures are often provided with tamper-evident buttons at the center of their closure panels, where they overlie the mouth of the container to which they are fitted. The button is an integral, raised and circular part of the closure panel, which is held in an inverted, depressed position by the normal vacuum which is created in the container headspace by the closing process, but which returns resiliently to its raised position if the vacuum is for any reason subsequently broken or substantially reduced. The button thus indicates, for example, if the contents of the container have "blown", or if the closure has not made a proper seal with the container.

One intended function of the button is to indicate if the container has been opened, possibly with a view to contaminating its contents by addition of a harmful substance. However, it is possible for a technically knowledgeable person to remove the closure and replace it in such a way that a substantial vacuum is again created in the container headspace so that the button is again held in its depressed position. The button cannot therefore be relied upon to indicate tampering, and there is a commercial need to provide a PT closure with a feature which, with suitable arrangement, can be more reliably indicative of tampering than would be a conventional tamper-evident button. As will become apparent from the described embodiment, however, whilst it provides tamper-evidence in its own right, in its application to a PT closure the invention may advantageously be used in conjunction with a conventional tamper-evident button.

W. German Patent Publication OLS 2233305 at FIG. 5 shows a metal closure having an inturned curl formed around the free edge of its peripheral skirt. The curl serves to hold captive the top end of a plastics security ring which extends below the skirt and has a line of weakening along which it may be ruptured to provide access and tamper evidence. For that purpose the bottom end of the security ring is mechanically interlocked with a formation on the container when the closure is fitted.

The closure shown in OLS 2233305 is of the kind usually named "RO", "RO" being an abbreviation of "Roll-On" which alludes to the manner in which the skirt is formed with screw threads after the closure has been applied to the container to be closed.

RO closures are used extensively for liquid products such as fruit cordials and squashes, spirits and mineral waters. These products are filled cold, and do not require to be heat treated after filling and closing; moreover, the screw threads of the container to which they are applied may be given a substantial helix angle and axial extent, so enabling a line or lines of weakening of a plastics security ring to be reliably ruptured by axially directed tension which is generated in the security ring when the closure is unscrewed. In the closure of OLS 2233305 it is therefore largely immaterial as to whether or not the security ring is capable of rotating in relation to the closure.

In contrast, PT closures as mentioned above are used for products, for example baby food products and preserves, which are either hot-filled or are thermally pasteurized or sterilized after filling and closing. Moreover, because of limitations imposed by their manner of formation, their screw threads necessarily have a relatively small helix angle and are of a correspondingly small axial extent. With such an arrangement the limited axial movement of the closure which occurs on opening makes it difficult or impossible to achieve reliable operation of a plastics security ring if employing axially directed forces to achieve rupturing. Forces generated by relative angular movement of the closure and the locked bottom end of the security ring may be used instead, but this requires secure, specifically non-rotary, attachment of the top end of the security ring to the closure if it is to be effective.

A known characteristic of molded plastics articles is their tendency to soften and shrink when subjected to elevated temperatures. Thus, a plastics security ring secured to an inward curl formed around the free edge of a metal closure as proposed in OLS 2233305 would, when fitted to a container and subjected to elevated temperatures, tend to contract both bodily and radially inwardly towards the container. Any substantial contraction which occurs, however, may not only free the security ring from the closure curl to such an extent that relative rotary movement becomes possible between them, but also the security ring may move into contact with the container and perhaps subsequently become stuck to the container by product residue existing in that area.

Thus, there is a danger that, when the consumer later attempts to unscrew the closure, relative movement of the closure in relation to the whole of the security ring will prevent proper rupturing of the latter along its line or lines of weakening. Indeed, it is possible that the security ring may fail to rupture before the closure becomes disengaged from the screw thread formations of the container, so that the closure cannot be removed without considerable difficulty.

In circumstances such as are described above the present invention seeks to ensure that the non-rotary attachment of the security ring in the closure curl can survive the elevated temperatures to which the closure is subjected, so that the security ring can reliably operate by relative angular movement created between its top end and its locked bottom end when the closure is unscrewed. It will thus be apparent that the invention has particular application to PT closures, for which the axial movement generated by the threaded engagement of the closure with the container and which is therefore available to achieve rupturing of the security ring may be only about 1.5 mm. However, the invention is believed to be applicable to screw closures other than PT closures; the screw thread formations of the closures may either be preformed, or, as in a PT closure, they may be formed in situ when the closure is located on the container.

In accordance with the invention from a first aspect there is provided a screw closure for a container, which comprises a metal closure body having a closure panel to overlie the mouth of a container, and a skirt which is peripherally attached to the closure panel, has a generally cylindrical region on which a screw thread formation is formed or formable for engagement with the container, and extends beyond the generally cylindrical region to an inward curl which includes the free edge of the closure metal, the closure further including a plastics security ring which has a top portion held captive by the closure skirt and which extends axially beyond and interiorly of the curl to an integral bottom portion capable of making locked engagement with the container, the security ring having at least one line of weakening along which it is rupturable to enable the closure to be unscrewed from the container whilst leaving visible evidence of the same, wherein the security ring is adapted to rupture by relative angular movement of its said captive top and locked bottom portions, for holding the top portion captive and in a non-rotary manner the closure skirt having a substantially radially directed, annular shoulder which is disposed in spaced opposition to the inward curl intermediate the curl and the generally cylindrical region, the top portion of the security ring having an exterior lower shoulder portion which is received within the curl and surrounds a recess in which the said free edge of the closure metal is disposed.

In order that the invention may be more fully understood, a PT closure embodying the invention and a modification thereof will now be described, by way of example only, with reference to the accompanying drawings.

Figure 5:
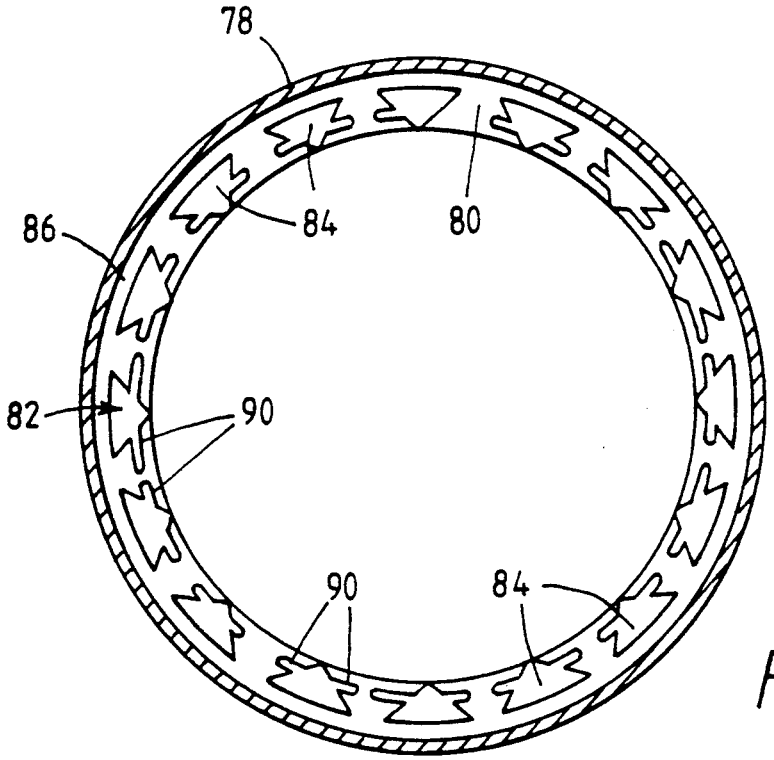
Figure 6:
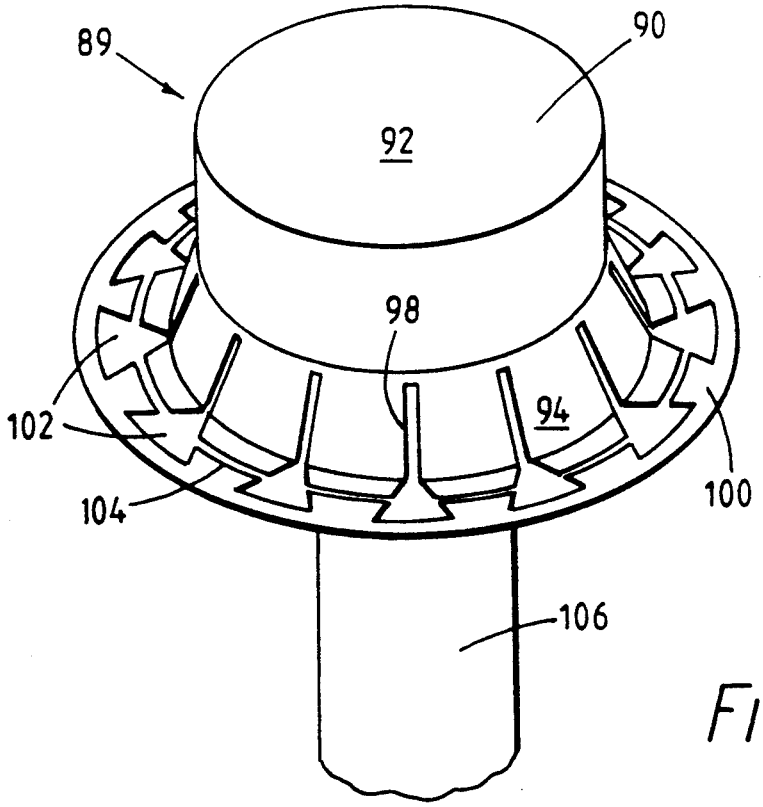
Figure 7:
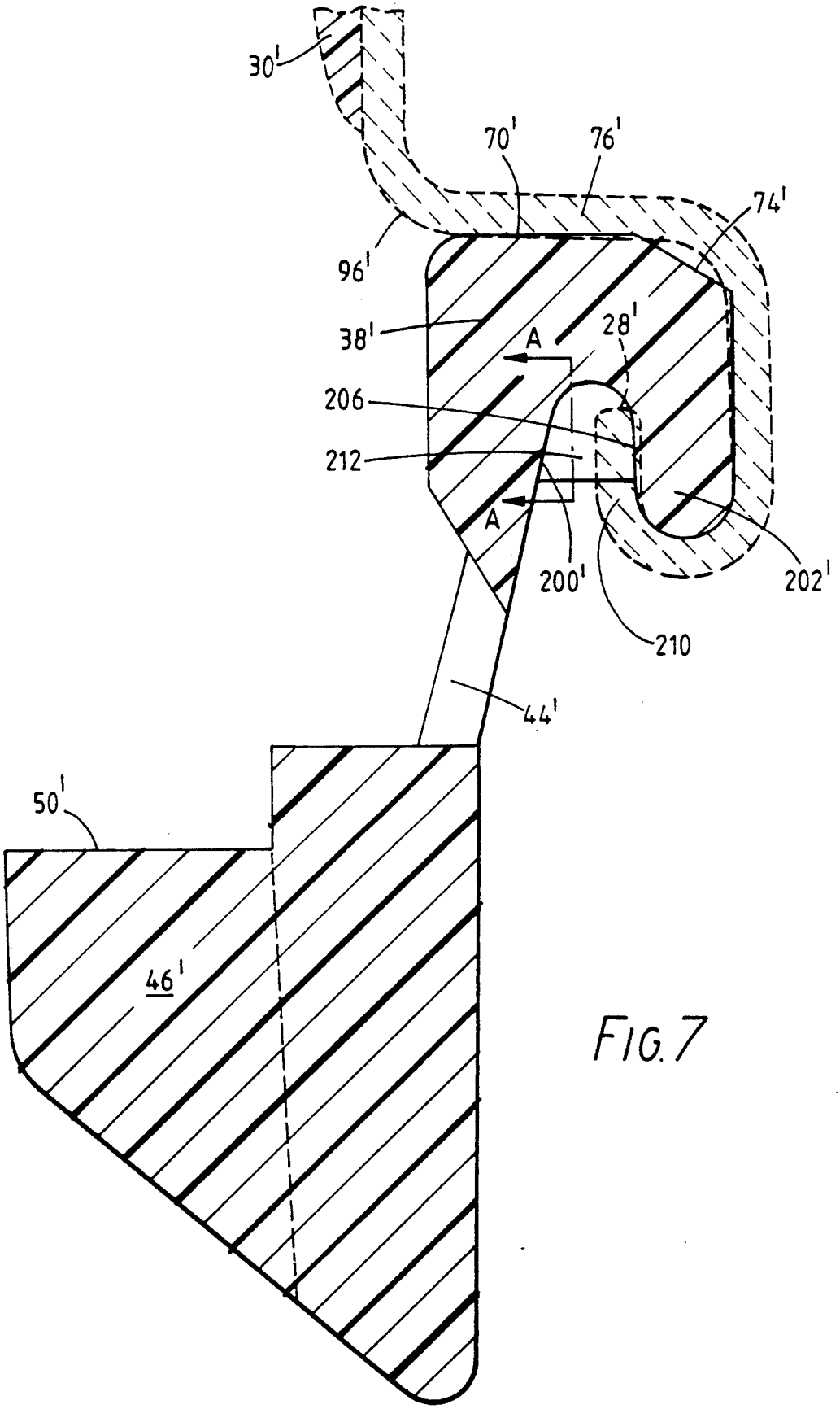
Figure 8:
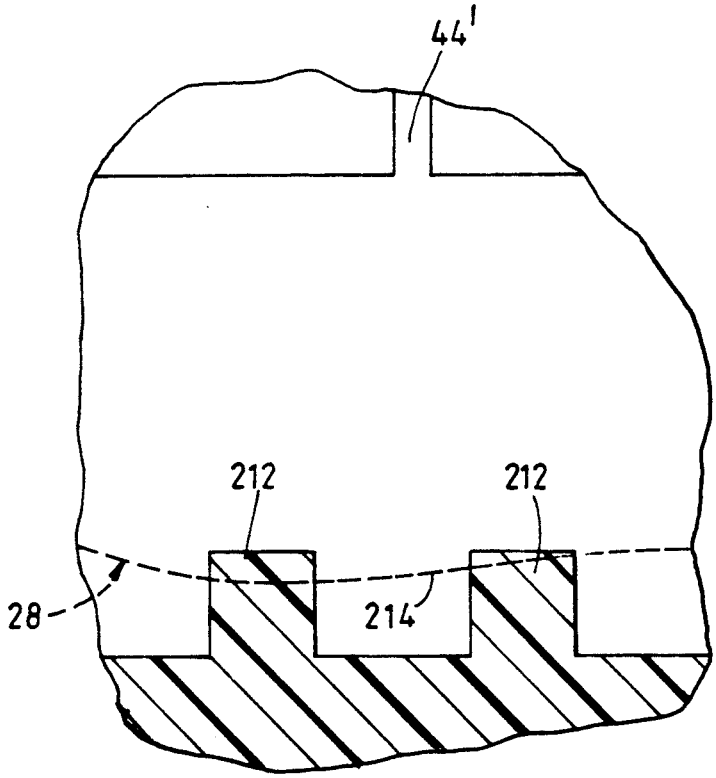
Figure 9:
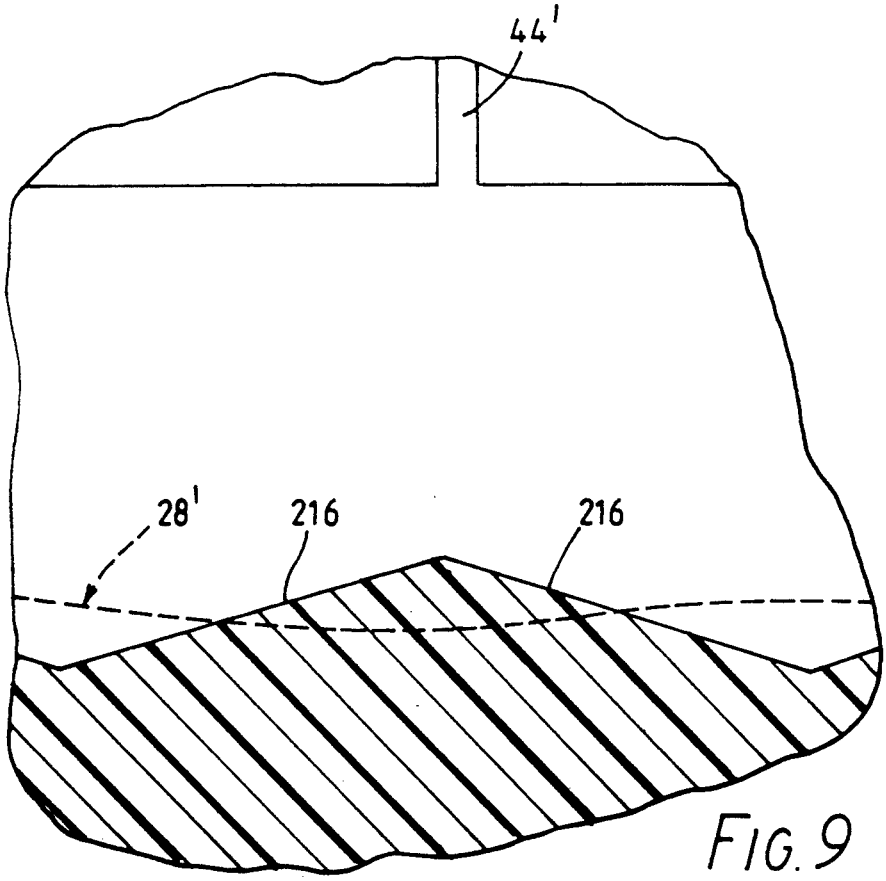

FIGS. 4(*a*), 4(*b*), 4(*c*) and 4(*d*) are scrap plan views of the top surface of the security ring, showing different raised formations which may be used;

FIG. 5 shows the underside of the top panel of the enlargement of the closure skirt;

FIG. 6 is a perspective view of the molding punch by which plastisol lining compound is distributed within the interior of the closure body;

FIG. 7 is a view in radial section of part of a modified closure showing the security ring as it appears before attachment to the closure body;

FIG. 8 is a scrap view of the modified closure taken in section along the line A—A of FIG. 7; and FIG. 9 is a similar view of a variant of the modified closure, taken in section along the line A—A of FIG. 7.

Figure 1:
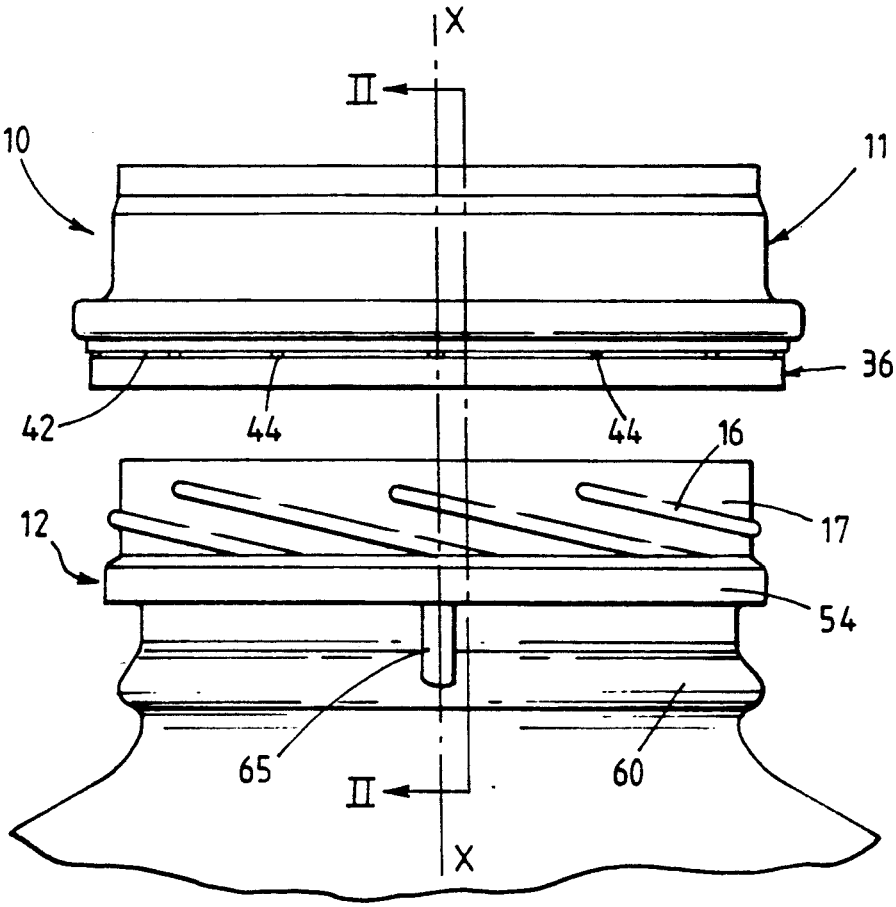
FIG. 1 is an exploded view of the PT closure as seen in relation to the neck of a glass container of a food product to which the closure is fitted, both the closure and the container neck being shown in side elevation.
Figure 2:
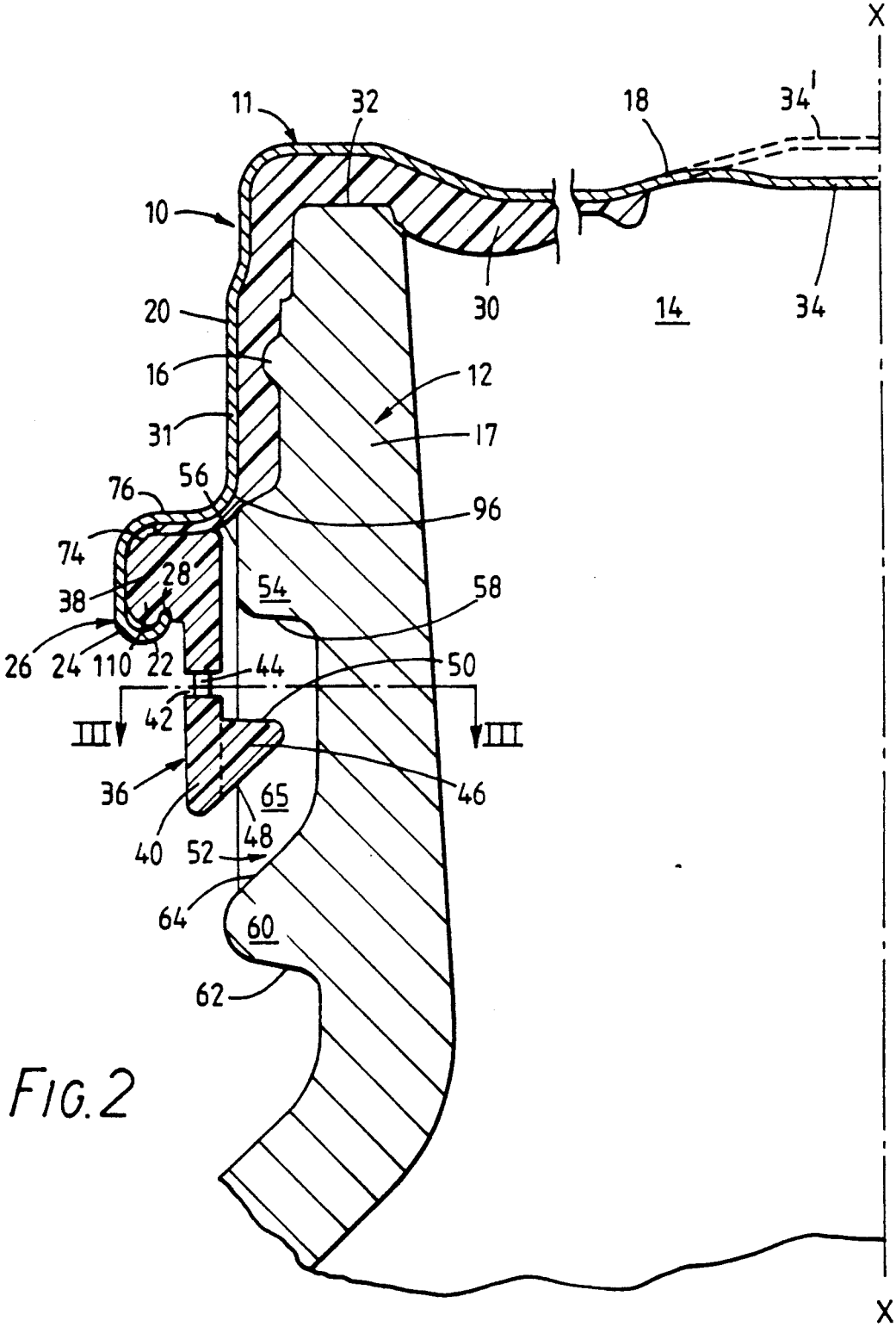
FIG. 2 is a sectional view taken on the line II—II of FIG. 1 and to a larger scale, showing the engagement of the closure with the container neck.

Referring now to FIGS. 1 and 2, a PT closure 10 is shown in relation to the generally cylindrical neck 12 of a glass container for a baby food product, the common central axis of the container and closure being indicated by the line XX. The neck defines the container mouth 14, and is externally formed with a multi-start screw thread 16 with which the closure may engage for its removal or replacement by the user in known manner. The screw thread is formed on a cylindrical portion 17 of the container neck.

The PT closure 10 has a metal body 11 which is conventionally formed by pressure from a suitable sheet material, with a generally plane closure panel 18 overlying the container mouth 14, and a tubular skirt 20 which is peripherally attached to the closure panel and extends from there to a free edge 22 formed by an inturned curl 24 at the end of the skirt. As shown in FIG. 2, the terminal edge 28 of the metal sheet material of which the body is formed is located within the curl so as to face generally axially of the closure towards the closure panel 18.

The interior of the body 11 has a lining 30 of a conventional plastisol gasket compound which is arranged to extend across the top free edge 32 of the container neck 12, and down the inside of the skirt 20. In known manner the lining 30 when first formed has a cylindrical bore which is an interference fit with the screw thread 16 of the container; the closure 10 is fitted onto the container by the food packer by simple axial movement, and during thermal processing of the container the lining takes a set by which it is made permanently to conform to the container screw thread for subsequent twist-off removal or replacement of the closure by the user.

Insofar as it has been described above the closure 10 is conventional. Also conventionally, it has a circular button 34 formed in its closure panel 18 and arranged to indicate whether or not a vacuum of the required level exists in the headspace of the container. In the drawing the button is represented by full lines as it appears when in its inverted, depressed position, indicating the existence of a vacuum; its relaxed, raised position is indicated at 34' by the broken lines. However, and as has previously been discussed, it is possible for a person wishing to tamper with the contents of the container to reestablish a vacuum in the headspace on reclosure. In order to provide evidence of such behavior the closure further includes a security ring 36 which is molded from a suitable polymeric material such, for example, as polypropylene. The security ring is of generally uniform cross-section, and has an annular top portion 38 which is held captive by the skirt. For that purpose the skirt has a terminal enlargement 26 in which the portion 38 of the security ring is received and which includes the curl 24. The formation and arrangement of the enlargement and its engagement with the security ring will be described later in detail.

From the top portion 38 the ring member extends, in a generally axial direction away from the closure panel 18, past and beyond the curl 24 and the free edge 22 of the skirt. Beyond the free edge 22 the security ring has a generally cylindrical bottom portion 40 which is attached along a line of weakening. The line of weakening is formed by a narrow gap 42 between the portions 38 and 40, and a plurality of thin, regularly spaced, integral and rupturable bridges 44 which span the gap and attach the portions 38, 40 together.

The bottom portion 40 of the security ring is arranged for locking engagement with the container neck and for that purpose has an even number (e.g. 30) of circumferentially spaced barbs or teeth 46 formed around its inner periphery.

Each barb has a downwardly and outwardly inclined camming surface 48 and a substantially radial (i.e plane) upper surface 50, these two surfaces together defining an apex which projects radially towards the container neck as shown in FIG. 2.

As shown in FIGS. 1 and 2, for cooperation with the barbs 46 the container neck is formed with a peripheral groove 52 which is separated from the threaded portion 17 by a continuous land or projection 54 having a cylindrical outer surface 56. The bottom surface 58 of the land forms the top face of the groove and is directed substantially radially as shown.

Opposite the land 54, the bottom face of the groove 52 is provided by a continuous and conventional transfer ring 60 by means of which the container may be lifted and/or transported as required during its manufacture. The transfer ring accordingly has a substantially radial lower surface 62 which may be engaged by a lifting/transporting mechanism (not shown). The upper surface 64 of the transfer ring, forming the bottom face of the groove, is downwardly and outwardly slanted as shown. In the fitted position of the closure a substantial vertical clearance exists between this surface and the camming surfaces 48 of the security ring, for the reason later to become apparent.

The barbs 46 project into the groove 52 within the vertical confines of the land 54 and of the transfer ring 60. As can clearly be understood from FIG. 1, the groove is continuous except at two discontinuities which are created by vertical ribs 65. These ribs bridge the groove at two diametrically opposed locations on the container neck, and occupy substantially the depth of the groove. To facilitate molding, the ribs are angularly spaced by 90° from the mold parting line of the container.

Figure 3:
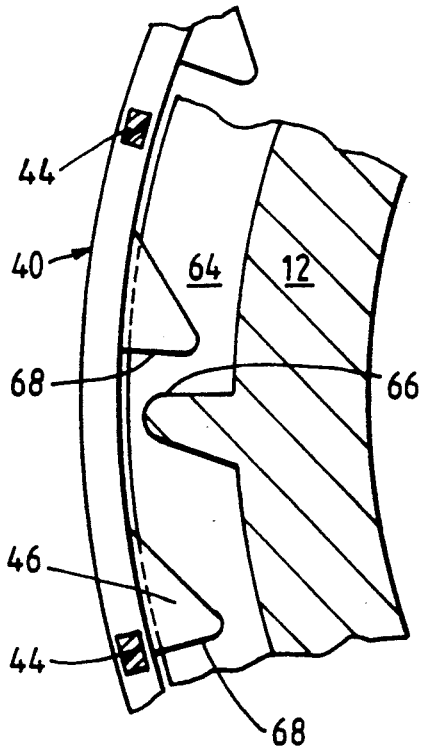
FIG. 3 is a scrap view of the container/closure combination, as seen on the line III—III of FIG. 2.

As can be seen from FIG. 3, the leading side faces 68 of the barbs 46 in the direction of an unscrewing movement of the closure are substantially radially directed, and therefore capable of making face-to-face abutment with the appropriate side faces 66 of the ribs 65; for that purpose, the faces 66 are, within molding limitations, normal to the groove surface from which they rise.

When the closure is applied to the container by axial movement as previously mentioned, the camming surfaces 48 of the barbs 46 ride down the screw thread 16 and land 54 of the container neck until the fitted position of the closure 10 is reached. The barbs are then generally as illustrated in FIGS. 2 and 3, that is to say, they are freely located in the groove 52.

Therefore, if an attempt is subsequently made to unscrew the closure 10, two diametrically opposed barbs 46 will engage the ribs and prevent closure removal until the bridges 44 are broken and the bottom portion 36 becomes disconnected from the closure. The bottom portion is then free to drop down onto the transfer ring 60, so providing clear evidence that the closure has been partially or wholly unscrewed. It is hoped to so arrange the security ring and its relationship with the closure and the container that this tamper evident function is effective before the vacuum is broken in the container and the button 34 is released. A further security function of the security ring becomes effective if an attempt is made to pry off the closure using axial movement without rotation. The barbs 46 and the land 54 will then engage one another at their respective surfaces 50 and 58 (FIG. 2), so that, as before, closure removal can only be accomplished by rupturing the bridges 44.

When the closure is being first applied to the container, it may happen that two of the barbs 46 coincide angularly with the ribs 65. Those barbs may then ride along the ribs and remain there until freed by rotary movement of the closure through a small angle, whereupon they will spring resiliently into the groove 52 in readiness for engaging the side faces 66 of the ribs as described above.

From the foregoing it will be understood that the security ring is primarily required to operate by rotational movement of the closure on the container neck, the usual small helix angle and axial extent of the screw thread 16 of the PT closure 10 making it unsatisfactory or impractical to rely upon axial movement for achieving operation.

Operation of the security ring by rotational movement itself requires that the security ring be securely held by the closure body 11 against rotation, despite softening of the polymeric material of the security ring and a tendency for it to contract both bodily and radially inwardly when the closed container and its contents are subjected to thermal sterilization. FIGS. 4 to 8 illustrate how secure non-rotary attachment of the security ring to the closure body may be achieved.

The various parts of FIG. 4 are scrap views of the security ring as it appears before incorporation into the closure and as seen from above. In FIG. 4(*a*) the top face 70 of the top portion 38 of the security ring is molded with a pattern of raised and intersecting ribs 72A. FIG. 4(*b*) illustrates a variant in which the face 70 is formed with raised ribs 72B which are separate and angularly inclined in relation to the axis XX, and FIG. 4(*c*) illustrates a further variant having raised ribs 72C which are separate and radially directed. In the variant shown in FIG. 4(*d*) the face 70 is molded with a pattern of raised pimples 73. In each of the four variants, and as shown, the top portion is formed with a chamfer 74 around the outside periphery of its face 70. As shown in FIG. 2, in the assembled closure this chamfer ensures that a free space is available outside the face 70 to prevent compressive stresses in the polymer material of the security ring from generating substantial and radially inwardly directed forces in the locality of the face.

The enlargement 26 of the closure skirt 20 has an annular and substantially plane top panel or shoulder 76 with which the face 70 engages. The shoulder is attached to the curl 24 by a cylindrical panel 78 which bounds the outside periphery of the top portion 38 of the security ring. In order to ensure a high effective resistance to relative movement along its interface with the face 70, the shoulder is itself treated by forming its lower surface 80 with a thin lining 82 of the plastisol compound of the lining 30. As will shortly become apparent, the lining 82 is formed at the same time as the lining 30, and constitutes an extension of that lining. However, whereas the lining 30 extends continuously around the closure, by virtue of the manner in which it is formed the lining 82 is discontinuous around the shoulder.

FIG. 5 shows the lower surface 80 of the shoulder 76 as it is presented to the top face 70 of the security ring, the cylindrical panel 78 being shown in section. From that figure it will be seen that the plastisol lining 82 has the form of a series of regularly spaced and generally triangular formations 84 having their apices located on the inner periphery of the shoulder. A narrow annular margin 86 lacking any lining compound is located around the outside periphery of the shoulder and serves a similar function to the chamfer 74 (as previously described). Also, surplus plastisol material from the molding operation is distributed on a circular locus in the spaces between adjacent formations 84, so as randomly to form partial bridges 90.

The triangular formations 84 and partial bridges 90 are created from uncured plastisol compound which is deposited on the shoulder 76 at the same time as compound is being placed on the closure panel 18 and the cylindrical part 31 of the skirt 20. In known manner liquid plastisol compound is flowed into the base periphery of the inverted closure body while the latter is rotating, and a heated molding punch is subsequently inserted into the body so as by hydraulic action to distribute the compound where required. In a conventional PT closure these operations are performed on the completed closure, that is, after the usual inward curl has been formed on the skirt. For the purposes of the present invention, however, the operations are performed before the curl 24 is formed or the security ring is in place, and at a time when the metal destined to create the curl still forms a cylindrical extension of the skirt.

Reference is now made to FIG. 6 in which for ease of understanding the axial dimensions have been magnified. The molding punch 89 has a central portion 90 arranged for entering the cylindrical part 31 of the skirt. The central portion has an end face 92 which is conventionally shaped so as to confine compound flow to the desired outer marginal region of the closure panel. Adjacent the end face the molding punch is generally cylindrical and dimensioned for distributing compound over the cylindrical part 31 of the skirt, where the screw thread of the closure is to be formed. Above its cylindrical surface, that is to say, remote from the end face 92, the central portion has a frustoconical surface 94 dimensioned so as when the molding punch is in its desired operating position in relation to the closure to engage the elbow 96 (FIG. 2) which is formed between the cylindrical and enlarged portions (31, 26) of the skirt. The engagement then serves to provide centralization for the molding punch; in addition, it serves to control the flow of compound onto the shoulder 76 by providing a peripheral seal except at a plurality of regularly spaced locations corresponding to the apices of the triangular formations 84 (FIG. 5). Compound flow at these locations is provided by small axially directed grooves 98 which are formed along the surface 94 so as to bypass the sealing engagement between the molding punch and the closure at the elbow 96. Compound which is forced through these grooves by hydraulic pressure when the molding punch is inserted moves in a generally radially outward direction along an interface which is formed with the shoulder 76 by a contoured annular face 100 of the tool surrounding the frustoconical face 94.

The face 100 has relieved triangular areas 102 which are destined to form the formations 84 of the lining 82 and which accordingly communicate with the grooves 98 for supply of plastisol lining compound. Channels 104 extending on a circular locus between the triangular areas provide a sump for accommodating surplus compound by forming the partial bridges 90 previously mentioned. The molding punch is mounted on a shaft 106 by which it may be moved into and out of the closure. Except at the triangular areas 102, the face makes face-to-face contact with the lower surface 80 of the shoulder 76 when the molding punch is in its fully inserted position.

As previously mentioned, the lining compound is placed in position before the curl 24 is formed or the security ring placed in position. The compound is then cured in an oven, and in known manner expands or puffs generally in proportion to the depth of compound. The security ring is then placed in position within the skirt enlargement 26, and the rollers of a rotating curling head (not shown) are engaged with the upstanding free edge 28 of the skirt and in known manner form the curl 24 by causing progressive inward deformation of a terminal part of the enlargement which projects beyond the top portion 38 of the security ring. The axial forces exerted on the skirt during this time are substantial, with the result that the free edge 28 of the skirt becomes deeply indented in the security ring, and a substantial residual compressive stress remains in the security ring after curling is completed.

Firm support for the closure while curling is taking place is provided by an annular support tool (not shown) within which the closure is received. The tool supports the closure by engagement with the exterior surface of the shoulder 76 of its skirt enlargement 26, the generally plane nature of the shoulder 76 ensuring that the axial forces exerted by the curling head are substantially localized to the skirt enlargement, and no deformation of the closure occurs except where required.

After curling, the closure is ready for dispatch and fitting to a container as previously described. By virtue of the residual compressive stress within the top portion 38 of the security ring and its firm engagement by the curl 24, no substantial relative movement of the security ring in relation to the container body is possible despite any thermal sterilization process to which the closed container may be subjected. Above the portion 38 of the security ring, lack of any substantial relative motion is ensured by the enhanced frictional resistance generated at the interface by generally random indenting engagement of the molded formations 72 of FIG. 4 with the triangular areas 84 of lining compound (including the partial bridges 90) of FIG. 5. At the bottom of the ring portion 38 relative movement is resisted by the deep indentation of the polymer material by the free edge 28 of the skirt, which for that purpose may be serrated if desired; in addition, the ring portion 38 has a bulbous annular rib 110 molded on its underside where the curl is to be formed. This rib substantially fills the curl and in particular provides substantial resistance to radial movement of the security ring in relation to the closure body despite contraction of the plastics material of the security ring which may occur.

Figure 2A:
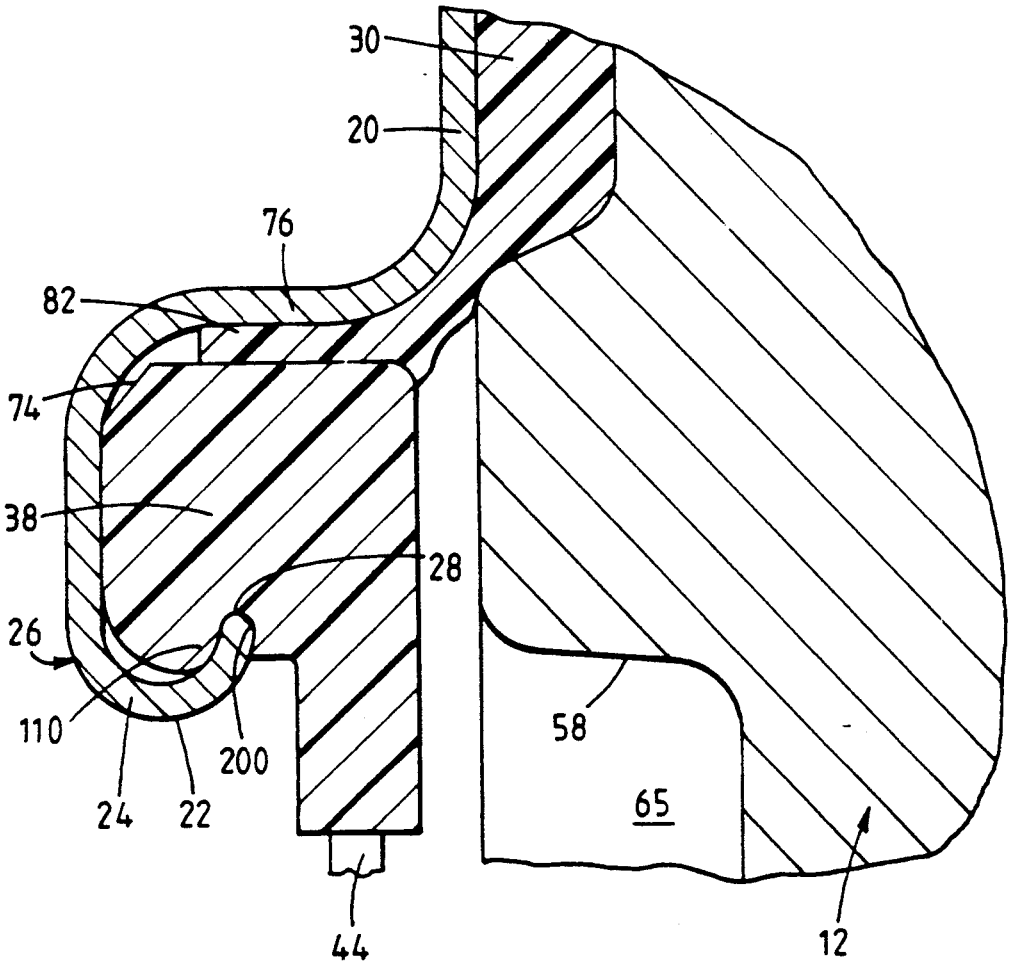
FIG. 2A is a substantially enlarged view of part of FIG. 2, showing the attachment of the security ring to the closure body.
Figure 4A:
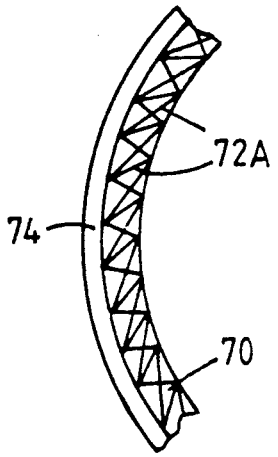
Figure 4B:
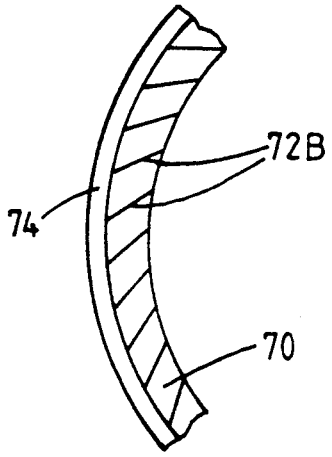
Figure 4C:
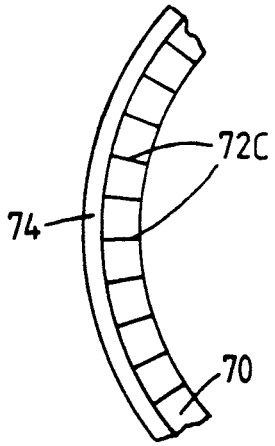
Figure 4D:
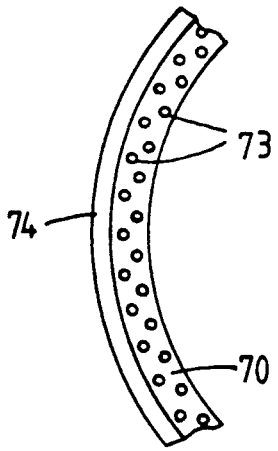

When indenting the security ring as described above, the free edge 28 of the skirt creates for itself a conforming recess in the security ring. FIG. 2A shows the engagement of the free edge in the security ring to a greater scale than is shown in FIG. 2, the conforming recess being particularly denoted in FIG. 2A by the reference numeral 200. Also clearly apparent from FIG. 2A is the substantial degree of interference, axially of the closure, which exists between the free edge of the closure body and the part of the security ring lying within the curl and including the rib 110. This interference provides the substantial resistance to relative radial movement which is provided at the bottom of the top portion 38 of the security ring and discussed in the preceding paragraph.

FIG. 7 shows a modification of the embodiment previously described, in which the security ring is molded with a recess 200' into which the free edge 28' of the closure metal can be entered by the curling operation. The recess defines a bulbous and downwardly extending shoulder portion 202' of the security ring. After the curl has been formed this portion lies within, and generally conforms to the curl. It has a substantially cylindrical inner surface 206 in engagement with a generally cylindrical terminal portion 210 of the curl which carries the free edge 28'.

By virtue of this engagement the portion 202', and thereby the security ring as a whole, is restrained from inward movement caused by contraction of the security ring during thermal processing. Applicants have found that, because the degree of penetration of the free edge into the security ring is substantially increased over the degree of penetration which can be reliably achieved by simple indentation as in the embodiment described above with reference to FIGS. 1 to 6, the retention of the security ring by the curl is made more secure than before, and any tendency for the security ring to move inwardly past the free edge 28' along generally chordal lines is prevented.

In the embodiment described above with reference to FIGS. 1 to 6 substantial axially directed compressive stress is created in the top portion 38 of the security ring by the curling operation. In this embodiment, however, the axial stress produced by curling is substantially smaller, the radial location of the top portion 38' being primarily achieved by the firm, essentially radial, engagement of the shoulder portion 202' between the opposed wall of the curl, assisted by the greater penetration of the curl in the top portion 38'. Whilst, as in the previous embodiment, the cooperating surfaces of the security ring and the shoulder may be arranged to provide an enhanced resistance to relative movement between them, Applicants believe that adequate location may be achieved even if, as shown, neither one of those surfaces is specially formed or treated; specifically, in FIG. 7 the upper surface 70' of the security ring is essentially plane, and the gasket compound 30' is not extended to cover the shoulder 76' but instead is terminated short of the elbow 96' between the shoulder 76' and the thread-forming part of the skirt—(compare FIG. 2).

As will now be understood from FIGS. 7 and 8, in the described modification a substantial resistance to rotary movement of the security ring in the closure body is generated within the recess 200' by crushing or indenting engagement of the free edge 28' of the closure body with a plurality of spaced ribs or lands 212 each of which rises from the base of the recess and spans the opposed walls of the recess. Usually the free edge 28' will have "ears" which are naturally formed undulations created when the closure body is being pressed from a flat metal blank; these ears will tend to enhance the resistive effect of the engagement of the free edge 28' with the ribs or lands 212.

In the variant of the security ring shown in FIG. 9 the ribs or lands are replaced by a succession of shallow and regular formations 214 having plane, inclined flanks and these formations are randomly indented by the free edge 28' of the recess 200' to a greater or lesser degree, depending upon the extent of "earing". In a further variant, not illustrated in the drawings, the base of the recess is flat (peripherally of the closure), and the free edge 28' indents it over all or a substantial part of its lengths. Alternatively or additionally, the free edge 28' itself may be artificially formed with serrations or undulations of suitable form for engagement with the plastics material at the base of the recess 200'.

I claim:

1. A screw closure for a container having a mouth comprising a metal closure body having a closure panel adapted to overlie a mouth of a container and a skirt which is peripherally attached to the closure panel and extends to a free edge, said skirt having a generally cylindrical region interiorly provided with means for conforming to a screw thread of an associated container, an inward curl adjacent said cylindrical region which terminates at said free edge, the closure further including a plastic security ring having a top portion held captive by the curl and an integral bottom portion which has locking means projecting interiorly of the curl for preventing rotation of the closure by engagement with an associated container, the security ring having at least one line of weakening between said top and bottom portions along which said security ring is rupturable to enable the closure to be unscrewed from an associated container while leaving visible evidence of the rupture, said security ring being adapted to rupture by relative angular movement between said top and bottom portions, said closure skirt having a substantially radially directed annular shoulder disposed in axially spaced opposition to the inward curl for holding the top portion captive in a non-rotary manner, the top portion of the security ring being compressively engaged between the annular shoulder of the skirt and said curl, said security ring top portion having a radially exterior annular lower shoulder portion which is received within the curl, a recess which defines an inner periphery of the security ring annular shoulder portion, and said free edge being disposed within said recess and making deforming engagement with the top portion of the security ring at a base of said recess.

2. A screw closure according to claim 1, wherein said recess is formed by indenting engagement of said free edge with the plastic security ring.

3. A screw closure according to claim 1, wherein the recess is formed in the security ring prior to attachment of the security ring to the closure body.

4. A screw closure according to claim 3, wherein the security ring has a plurality of spaced formations which are located within the recess and are deformed by the free edge of the closure body.

5. A screw closure according to claim 1, wherein the free edge of the closure body is formed with one of a plurality of undulations and serrations.

6. A screw closure according to claim 1, arranged for the bottom portion of the security ring to become detached and to separate from the top portion on rupturing of the security ring along the at least one line of weakening.

7. A screw closure according to claim 1, wherein said locking means comprise a plurality of circumferentially spaced and inwardly projecting integral teeth.

8. A screw closure according to claim 1, wherein the shoulder of the skirt has a lining of a gasket compound for engagement by the top portion of the security ring.

9. A screw closure according to claim 8, wherein the lining on the shoulder is a continuation of a lining formed on the generally cylindrical region of the skirt and in which said screw thread is formed.

10. A screw closure according to claim 1, wherein for engagement with the shoulder of the skirt the top portion of the security ring is molded with at least one raised formation.

11. A screw closure according to claim 1, wherein the line of weakening of the security ring comprises a gap separating the top and bottom portions, and a plurality of rupturable integral bridges spanning the gap.

12. A screw closure for a container having a mouth comprising a metal closure body having a closure panel adapted to overlie a mouth of a container and a skirt which is peripherally attached to the closure panel and extends to a free edge, the skirt having a generally cylindrical region interiorly provided with a screw thread for engagement with a container, an inward curl adjacent said cylindrical region which terminates at said free edge, said closure further including a plastic security ring having a top portion held captive by the curl and an integral bottom portion which has locking means projecting interiorly of the curl for preventing rotation of the closure by engagement with an associated container, the security ring having at least one line of weakening between said top and bottom portions along which said security ring is rupturable to enable the closure to be unscrewed from an associated container while leaving visible evidence of the rupture, said security ring being adapted to rupture by relative angular movement between said top and bottom portions, said closure skirt having a substantially radially directed annular shoulder disposed in axially spaced opposition to the inward curl for holding the top portion captive in a non-rotary manner, the top portion of the security ring being compressively engaged between the annular shoulder of the skirt and said curl, security ring top portion having a radially exterior annular lower shoulder portion which is received within the curl, a recess which defines an inner periphery of the security ring annular shoulder portion, and said free edge being disposed within said recess and making deforming engagement with the top portion of the security ring at a base of said recess.

13. A screw closure for a container having a mouth comprising a metal closure body having a closure panel adapted to overlie a mouth of a container and a skirt which is peripherally attached to the closure panel and extends to a free edge, the skirt having a generally cylindrical region interiorly provided with means for forming to a screw thread of an associated container, an inward curl adjacent said cylindrical region which terminates at said free edge, said closure further including a molded plastic security ring having a top portion held captive by the curl and an integral bottom portion which has a plurality of cirumferentially spaced and inwardly projecting integral teeth for preventing rotation of the closure by engagement with an associated container, the security ring having at least one line of weakening between said top and bottom portions along which said security ring is rupturable to enable the closure to be unscrewed from an associated container while leaving visible evidence of the rupture, said security ring being adapted to rupture by relative angular movement between said top and bottom portions, said closure skirt having a substantially radially directed annular shoulder disposed in axially spaced opposition to the inward curl for holding the top portion captive in a non-rotary manner, the top portion of the security ring being compressively engaged between the annular shoulder of the skirt and said curl, security ring top portion having molded in a lower surface thereof a recess which includes a base, a plurality of downwardly projecting integral formations spaced along said recess base, and said free edge being disposed within said recess and making deforming engagement with said plurality of downwardly projecting formations.

14. A screw closure for a container having a mouth comprising a metal closure body having a closure panel adapted to overlie a mouth of a container and a skirt which is peripherally attached to the closure panel and extends to a free edge, said skirt having a generally cylindrical region interiorly provided with means for conforming to a screw thread of an associated container, an inward curl adjacent said cylindrical region which terminates at said free edge, the closure further including a plastic security ring having a top portion held captive by the curl and an integral bottom portion, the security ring having at least one line of weakening between said top and bottom portions along which said security ring is rupturable to enable the closure to be unscrewed from an associated container while leaving visible evidence of the rupture, said closure skirt having a substantially radially directed annular shoulder disposed in axially spaced opposition to the inward curl for holding the top portion captive, the top portion of the security ring being compressively engaged between the annular shoulder of the skirt and said curl, said security ring top portion having a radially exterior annular lower shoulder portion which is received within the curl, a recess which defines an inner periphery of the security ring annular shoulder portion, and said free edge being disposed within said recess and making deforming engagement with the top portion of the security ring at a base of said recess.

15. A screw closure for a container having a mouth comprising a metal closure body having a closure panel adapted to overlie a mouth of a container and a skirt which is peripherally attached to the closure panel and extends to a free edge, the skirt having a generally cylindrical region interiorly provided with a screw thread for engagement with a container, an inward curl adjacent said cylindrical region which terminates at said free edge, said closure further including a plastic security ring having a top portion held captive by the curl and an integral bottom portion, the security ring having at least one line of weakening between said top and bottom portions along which said security ring is rupturable to enable the closure to be unscrewed from an associated container while leaving visible evidence of the rupture, said closure skirt having a substantially radially directed annular shoulder disposed in axially spaced opposition to the inward curl for holding the top portion captive, the top portion of the security ring being compressively engaged between the annular shoulder of the skirt and said curl, said security ring top portion having a radially exterior annular lower shoulder portion which is received within the curl, a recess which defines an inner periphery of the security ring annular shoulder portion, and said free edge being disposed within said recess and making deforming engagement with the top portion of the security ring at a base of said recess.

16. A screw closure for a container having a mouth comprising a metal closure body having a closure panel adapted to overlie a mouth of a container and a skirt which is peripherally attached to the closure panel and extends to a free edge, the skirt having a generally cylindrical region interiorly provided with means for conforming to a screw thread of an associated container, an inward curl adjacent said cylindrical region which terminates at said free edge, said closure further including a molded plastic security ring having a top portion held captive by the curl and an integral bottom portion, the security ring having at least one line of weakening between said top and bottom portions along which said security ring is rupturable to enable the closure to be unscrewed from an associated container while leaving visible evidence of the rupture, said closure skirt having a substantially radially directed annular shoulder disposed in axially spaced opposition to the inward curl for holding the top portion captive in a non-rotary manner, the top portion of the security ring being compressively engaged between the annular shoulder of the skirt and said curl, said security ring top portion having molded in a lower surface thereof a recess which includes a base, a plurality of downwardly projecting integral formations spaced along said recess base, and said free edge being disposed within said recess and making deforming engagement with said plurality of downwardly projecting formations.

* * * * *